US007821873B2

(12) United States Patent
Carley

(10) Patent No.: US 7,821,873 B2
(45) Date of Patent: Oct. 26, 2010

(54) METHOD AND APPARATUS FOR THE TREATMENT OF INCONTINENCE

(75) Inventor: Michael Edward Carley, Dallas, TX (US)

(73) Assignee: Baylor Research Institute, Dallas, TX (US)

( * ) Notice: Subject to any disclaimer, the term of this patent is extended or adjusted under 35 U.S.C. 154(b) by 0 days.

(21) Appl. No.: 11/520,777

(22) Filed: Sep. 13, 2006

(65) Prior Publication Data

US 2007/0058492 A1 Mar. 15, 2007

Related U.S. Application Data

(60) Provisional application No. 60/716,561, filed on Sep. 13, 2005.

(51) Int. Cl.
*G04F 8/00* (2006.01)

(52) U.S. Cl. ..... 368/9

(58) Field of Classification Search ..... 368/10, 368/107–113; 340/309.7, 309.3, 573.5, 604; 128/886; 604/361
See application file for complete search history.

(56) References Cited

U.S. PATENT DOCUMENTS

| | | | | |
|---|---|---|---|---|
| 4,451,158 | A * | 5/1984 | Selwyn et al. | 368/63 |
| 5,438,555 | A * | 8/1995 | Kim | 368/10 |
| 5,877,953 | A * | 3/1999 | Clendenen et al. | 700/17 |
| 5,929,747 | A * | 7/1999 | Rosenblatt et al. | 340/309.7 |
| 6,636,458 | B1 * | 10/2003 | Uptegraph | 368/88 |
| 2001/0051327 | A1 * | 12/2001 | Hatano et al. | 434/262 |
| 2002/0118604 | A1 * | 8/2002 | Sharma et al. | 368/10 |
| 2003/0123330 | A1 * | 7/2003 | Carter et al. | 368/109 |
| 2005/0248528 | A1 * | 11/2005 | Karcher et al. | 345/156 |

* cited by examiner

*Primary Examiner*—Edwin A. Leon
(74) *Attorney, Agent, or Firm*—Chainey P. Singleton; Edwin S. Flores; Chalker Flores, LLP

(57) ABSTRACT

The present invention includes a method, a kit and an apparatus for prompting a user of an urination event. The present invention includes a portable incontinence prompting apparatus having a timer mechanism for timing an interval disposed within a housing and a time interval selection mechanism in communication with the timer mechanism for selecting a preset time interval. The apparatus includes a prompting mechanism in communication with the timer mechanism for issuing a prompting signal in response to a signal from the timer timing mechanism.

11 Claims, 2 Drawing Sheets

METHOD AND APPARATUS FOR THE TREATMENT OF INCONTINENCE

TECHNICAL FIELD OF THE INVENTION

The present invention relates in general to the field of medical devices and methods, and more particularly, to devices and methods for prompting medical events as in the treatment of urinary incontinence.

BACKGROUND OF THE INVENTION

This application claims priority to U.S. Provisional Patent Application Ser. No. 60/716,561 filed Sep. 13, 2005, the entire contents of which are incorporated herein by reference.

Without limiting the scope of the invention, its background is described in connection with devices and methods for treatment of urinary incontinence, as an example. Incontinent persons often urinate or void in a diaper or clothing rather than in a toilet causing significant discomfort and distress to the person. Incontinence affects numerous men and women worldwide; however, it is more prevalent among postmenopausal women, e.g., 22-42% of the population. Additionally, it is estimated that 15% to 30% of noninstitutionalized persons over the age of 60 and more than 50% of persons over the age of 60, who reside in nursing homes suffer from urinary incontinence.

In woman, for example continence is maintained through the integrated normal function of pelvic floor muscles, fascial structures, nerves, supporting ligaments and the vagina. Although, theories differ (e.g., reduced muscular force, reduced muscular endurance, or reduced active and passive tone of the pelvic floor muscles) the normal functioning of pelvic floor tissues is common to these theories. Sources of urinary incontinence vary. The most common sources include stress incontinence, urge incontinence and overflow incontinence. Stress incontinence results when the pressure on the bladder exceeds the resistance in the urethra from movement, exercise, lifting, sneezing, coughing or laughing. Urge incontinence results unihibited contractions of the bladder and result in an abrupt and urgent need to urinate. Overflow incontinence results from the leakage of urine from the bladder when its maximal capacity is exceeded.

Currently there are numerous methods to treat incontinence. These methods can be divided into four categories: i) management apparatus, ii) behavioral modification, iii) pharmacologic treatment, and iv) surgical interventions. The management apparatus generally includes absorbent and/or catheter structures (e.g., a diaper-like structure) worn by a user to retain any urinary and/or fecal incontinence. They can also include plugs or barriers that obstruct the flow of urine through the urethra. This method is effective at hiding the results but does little to hide the embarrassment of the user. Behavioral modification (e.g., bladder re-training, Kegel exercises) has also been used treat incontinence by strengthen and retraining the pelvic floor muscles. In addition, there are a variety of associated devices and methods to aid in behavioral training, e.g., intravaginal, intra-anal devices. Incontinence is often treated with pharmacologic agents, but often results in drug-related side effects. Lastly, surgical treatments of incontinence often involve invasive procedures with risks of post-surgical failure, infections and complications.

The foregoing problems have been recognized for many years and while numerous solutions have been proposed, none of them adequately address all of the problems in a single device.

SUMMARY OF THE INVENTION

The present inventor recognized problems with the methods currently used for treating urinary incontinence, e.g., pharmacologic treatments have side effects, surgical treatments are invasive, risky and painful, neuromuscular stimulation treatments are invasive and painful. The present inventor recognized a need for a less invasive incontinence treatment and methodology, which reduces dependence on medication with harmful or uncomfortable side effects and eliminates the invasiveness of surgery The present invention includes a method, a kit and an apparatus for prompting a urination event for the user. For example, the present invention includes a simple portable incontinence prompting apparatus having a timer mechanism for timing an interval disposed within a housing and a time interval selection mechanism in communication with the timer mechanism for selecting a preset time interval. The apparatus has a prompting mechanism in communication with the timer mechanism for issuing a prompting signal in response to a signal from the timer mechanism.

For example, the present invention includes a portable incontinence kit for prompting of urination events having an incontinence timer with a timer mechanism disposed within a housing for timing intervals, a time interval selection mechanism in communication with the timer mechanism for selecting a preset time interval and a prompting mechanism in communication with the timer mechanism for issuing a prompting signal in response to a signal from the timer mechanism. The kit includes a recording device for recording urination events, times, volumes or combinations thereof.

In one embodiment, the method of the invention provides for controlling incontinence through voiding by providing a user with an incontinence timer having a timer mechanism disposed within a housing for timing an interval, a time interval selection mechanism disposed in or about a housing for selecting a preset time interval and in communication with the timer mechanism and a prompting mechanism in communication with the timer mechanism for issuing a prompting signal in response to a signal from the timer mechanism. The method includes selecting a time interval on the time interval selection mechanism, wherein the prompting signal produced by the incontinence timer causes a user to void the bladder and to reset the incontinence timer.

More particularly, the present invention provides an apparatus for prompting of urination events including a timer mechanism disposed within the housing for timing one or more intervals and a time interval selection mechanism disposed in or about a housing and in communication with the timer mechanism for selecting a preset time interval of 30 minutes, 60 minutes, 90 minutes, 120 minutes, 150 minutes and 180 minutes with a prompting mechanism in communication with the timer mechanism for issuing a signal in response to the timer timing mechanism.

Additionally, the present invention provides a single package incontinence kit for prompting of urination events including an incontinence timer having a timer mechanism disposed within a housing for timing intervals, a time interval selection mechanism in communication with the timer mechanism for selecting a preset time interval and a prompting mechanism in communication with the timer mechanism for issuing a prompting signal in response to a signal from the timer mechanism and one or more pharmacologically active agents packaged in a single package with the incontinence timer. The single package incontinence kit provides the pharmacological treatment (e.g., pharmacologically active agents) and behavioral treatment (e.g., the incontinence timer) in a single package.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
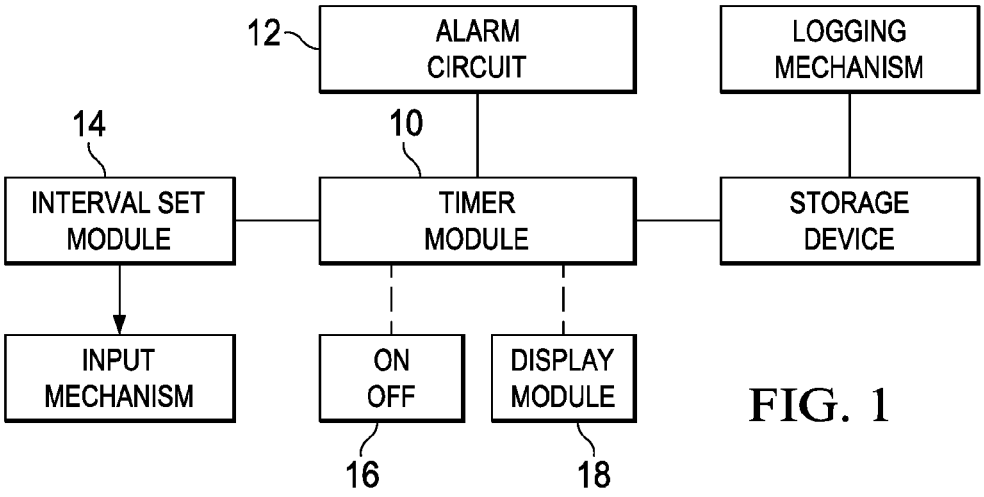
FIG. 1 is a schematic of the apparatus of the present invention.

While the making and using of various embodiments of the present invention are discussed in detail below, it should be appreciated that the present invention provides many applicable inventive concepts that can be embodied in a wide variety of specific contexts. The terminology used and specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Timed voiding is one of the most commonly used and effective behavioral techniques to aid adults with urinary incontinence in the minimization of incontinent episodes. Two primary forms of urinary incontinence exist and the present invention benefits for both. Stress urinary incontinence is a condition in which incontinence is caused by an increase in abdominal pressure. Common examples are loss of urine associated with coughing, sneezing, lifting etc. The fuller the bladder is when these stress activities occur the more likely the patient is to have an incontinent episode. The method and apparatus of the present invention includes timed voiding to encourage an individual to void prior to bladder fullness, thereby decreasing the possibility of urine loss. Urge incontinence is a condition in which the bladder spontaneously contracts at unwanted times and the pressure generated within the bladder is great enough to lead to urinary incontinence. The bladder tends to have a greater propensity to contract as it has greater volumes of fluid within it. Timed voiding using the present invention encourages a patient to void at a set interval rather than wait for a spontaneous unwanted bladder contraction.

Many adults with urinary incontinence have sensory changes in the bladder that impair their normal ability to detect bladder fullness. Encouraging patients with urinary incontinence is a critical behavioral intervention. Current medical therapy for urge incontinence or bladder overactivity is aimed primarily at decreasing bladder spasticity. Many patients on phamacotherapy are able to delay voiding for a longer time. However, when they do have a bladder contraction they tend to have a larger volume incontinent episode. For patients on phamacotherapy the present invention is extremely beneficial.

In one embodiment, the present invention also includes a voiding diary to record the time and amount of urine voided. Additionally, information may be recorded to aid in treatment, e.g., time, subjective amount, and cause of incontinent episodes. The information allows the time interval for voiding to be adjusted to minimize incontinent episodes. For example, if a user urinate every 2.5 hours and have an incontinent episode just prior to going to the bathroom we may recommend that they void every 2 hours to minimize these episodes. When used without the recording device a predetermined interval may be selected and adjusted accordingly. For example, begin at a 2-hour interval and either increase or decrease this time interval depending on their clinical response.

The present invention includes a kit, a method and an apparatus for prompting a user of an urination event. For example, the present invention includes a portable incontinence prompting apparatus having a timer mechanism for timing an interval disposed within a housing and a time interval selection mechanism in communication with the timer mechanism for selecting a preset time interval. The apparatus has a prompting mechanism in communication with the timer mechanism for issuing a prompting signal in response to a signal from the timer timing mechanism.

The skilled artisan will recognize that the housing may be of any size and shape desired from a wristwatch like shape to a cubical container design. Furthermore, the housing may be constructed in part or entirely from a variety of materials including metals, alloys, plastics, polymers, ceramics, wood, fiberglass, rubbers, composites and combinations thereof. Additionally, a conventional internal time keeping apparatus (not shown) may be used. Many such timepieces are known by those skilled in the art of watchmaking including, but not limited to, a mechanical or electrical watch or clock capable of keeping accurate time.

The time interval selection mechanism is in communication with the timer mechanism for selecting a preset time interval. The time interval selection mechanism may retain a series of preset intervals, e.g., 30 minutes, 60 minutes, 90 minutes, 120 minutes, 150 minutes and 180 minutes. However, the series of preset intervals may be set by the user, input by a user or preset in a variety of increments. The increments may be equally spaced (e.g., 15, 30, 45, 60, and 75 minutes) or non-equally spaced (e.g., 30, 45, 50, 55, 60, 65, 70, 80, 90, 95, 100 minutes and so on) to accommodate the specific needs of the user.

The time interval selection mechanism may include a vast array of mechanisms for selection. In the simplest embodiments the interval selection mechanism is a slider that is positioned to the corresponding time interval or knob that is rotated to the to the corresponding time interval. In more complicated embodiments, the time interval selection mechanism is a button that cycles through menus to select the time interval or a touch screen that aids in menu navigation.

The prompting mechanism issues a prompting signal in response to a signal from the timer timing mechanism. The prompting mechanism may include a variety of mechanisms, e.g., a vibrating mechanism, an auditory mechanism, a visual mechanism or a combination thereof. It is not necessary that these be multiple mechanisms may be located within the apparatus all of the individual mechanisms can be incorporated in to a single module. For example, a prompting mechanism may include a mechanism that combines a vibrating mechanism and an auditory mechanism, an auditory mechanism and a visual mechanism, a vibrating mechanism and a visual mechanism, a vibrating mechanism and an auditory mechanism and a visual mechanism or combinations thereof. The prompting mechanism may include a speaker, a buzzer, a vibration mechanism, a light source, a LED, a diode and various combinations thereof. In addition, the skilled artisan will recognize the vast array of other devices that may be used to provide an indication to the user.

In some embodiments, the portable incontinence prompting apparatus has a display mechanism for displaying one or more messages. The display may be simple in displaying the basic information needed by the user, e.g., hours and minutes remaining. The portable incontinence prompting apparatus may also display a variety of information including time, date, day, schedule, the time remaining, the time lapsed, the time interval selected, alarm mode, the date, the time, the day, the month or combinations thereof. The form of the display mechanism includes a simple analogue dial, a digital output, a LCD. In some embodiments, the display mechanism may be in the form of a touch screen that allows the direct input of information, and as such may be used as a log entry for urination time, amount and related notes.

The portable incontinence prompting apparatus is reset after use by either a manual reset or an automated reset. The manual reset is accomplished by pressing a button, moving a slider or turning the apparatus off and on again. The apparatus may include an automated reset mechanism that resets the timer module.

The present invention also includes a portable incontinence kit for prompting of urination events having an incontinence timer with a timer mechanism disposed within a housing for timing intervals, a time interval selection mechanism in communication with the timer mechanism for selecting a preset time interval and a prompting mechanism in communication with the timer mechanism for issuing a prompting signal in response to a signal from the timer mechanism. The kit includes a recording device for recording urination events, times, volumes or combinations thereof.

The recording device may be a simple diary or log in which the user may record the information or a more complicated direct input mechanism, e.g., a PDA, a computer, a note pad or combination thereof. In addition, the kit may include one or more pharmacologically active agents that may be used in conjunction with the incontinence timer to aid the user in managing incontinence. Suitable pharmacologically active agents, additives and/or auxiliary substances which aid the user in managing incontinence are well-known to those ordinarily skilled in the art for pharmaceutical formulations, e.g., parasympatholytics (e.g., oxybutynin, propiverine or tolterodine), tricyclic antidepressants (e.g., imipramine), muscle relaxants (e.g., flavoxate), ephedrine, clenbutarol, hormones, tramadol, opioids (e.g., diarylmethylpiperazines and piperidines) pharmaceutically acceptable salt thereof, combinations and mixtures thereof.

In addition, the present invention provides a method of controlling incontinence through voiding by providing an incontinence timer having a timer mechanism disposed within the housing for timing an interval, a time interval selection mechanism disposed in or about a housing for selecting a preset time interval and in communication with the timer mechanism and a prompting mechanism in communication with the timer mechanism for issuing a prompting signal in response to a signal from the timer mechanism. The method includes selecting a time interval on the time interval selection mechanism, wherein the prompting signal produced by the incontinence timer causes a user to void the bladder and to reset the incontinence timer.

In operation, a user sets the incontinence timer to the desired time interval using the time interval selection mechanism. The time interval selection mechanism will activate the timer mechanism and at the expiration of the selected time interval a signal is sent to the prompting mechanism that in turn signals the user to void the bladder and to reset the incontinence timer. The user may select the same time interval or may adjust the time interval to account for the time needed between bladder emptying. To aid in the method of controlling incontinence through voiding a log may be used to record events, e.g., event time, amount, date or combination thereof.

The incontinence timer includes a time interval selection mechanism in communication with the timer mechanism for selecting a preset time interval. The time interval selection mechanism retains a series of preset intervals, e.g., 30 minutes, 60 minutes, 90 minutes, 120 minutes, 150 minutes and 180 minutes. However, the series of preset intervals may also be set by the user, input directly by a user or preset in a variety of increments. The increments may be equally spaced (e.g., 15, 30, 45, 60, and 75 minutes) or non-equally spaced (e.g., 30, 45, 50, 55, 60, 65, 70, 80, 90, 95, 100 minutes and so on) to accommodate the specific needs of the user.

The time interval selection mechanism may include a vast array of mechanisms for selection. In the simplest embodiments, the interval selection mechanism may be a slider that is positioned to the corresponding time interval or a knob that can be rotated to the corresponding time interval. In more complicated embodiments, the time interval selection mechanism may be a button that cycles through menus to select the time interval or a touch screen that aids in menu navigation.

The prompting mechanism issues a prompting signal in response to a signal from the timer timing mechanism. The prompting mechanism may include a variety of mechanisms, e.g., a vibrating mechanism, an auditory mechanism, a visual mechanism or a combination thereof. It is not necessary that these be individual mechanism multiple mechanisms may be located within the apparatus. For example, a prompting mechanism may include a mechanism that combines a vibrating mechanism and an auditory mechanism, an auditory mechanism and a visual mechanism, a vibrating mechanism and a visual mechanism, a vibrating mechanism and an auditory mechanism and a visual mechanism or combinations thereof. The prompting mechanism may include a speaker, a buzzer, a vibration mechanism, a light source, a LED, a diode and various combinations thereof. In addition, the skilled artisan will recognize the vast array of other devices that may be used to provide an indication to the user.

In some embodiments, the portable incontinence prompting apparatus has a display mechanism for displaying one or more messages. The display may be simple in displaying the basic information needed by the user, e.g., hours and minutes remaining. The portable incontinence prompting apparatus may also display a variety of information including time, date, day, schedule, the time remaining, the time lapsed, the time interval selected, alarm mode, the date, the time, the day, the month or combinations thereof. The form of the display mechanism includes a simple analogue dial, a digital output, a LCD or a combination thereof. In some embodiments, the display mechanism may be in the form of a touch screen that allows the direct input of information, and as such may be used as a log entry for urination time, amount and related notes.

In one embodiment, the present invention provides an apparatus for the prompting of urination events including a timer mechanism disposed within the housing for timing one or more intervals and a time interval selection mechanism disposed in or about a housing and in communication with the timer mechanism for selecting a preset time interval comprising 30 minutes, 60 minutes, 90 minutes, 120 minutes, 150 minutes and 180 minutes with a prompting mechanism in communication with the timer mechanism for issuing a signal in response to the timer timing mechanism. For certain patents, the incontinence timer may be customized for their specific timing with a simple, single button operation voidance timer.

With reference to FIG. 1, a schematic of a portable incontinence prompting apparatus of the present invention. FIG. 1 shows a timer module 10, which activates an alarm circuit 12 at predetermined alarm intervals. When alarm circuit module 12 is activated, it produces an alarm signal, which may be audio, physical, mechanical, visual or combinations thereof. The timer module 10 receives a signal from the interval set module 14 to instruct the timer module 10 of the desired duration. In some instances, the duration is 30 minutes, 60 minutes, 90 minutes, 120 minutes, 180 minutes. However, other time increments may be used, e.g., a 15 minute interval, a 20 minute interval, a 45 minute interval or variable intervals. The alarm intervals can be set either by the user via an interval set module 14 or automatically reset to start the countdown again. Alternatively, a reset button (not shown) may be in communication with the timer module 10 to restart the countdown of the alarm circuit module 12. Optionally, the timer module 10 may be connected to an on-off switch module 16 or a mute switch or button (not shown). However, the on-off switch module 16 may be integrated into the interval set module 14 to provide on-off and time intervals in one module. Optionally, a display module 18 may be connected to the timer module 10 to display information.

Figure 2:
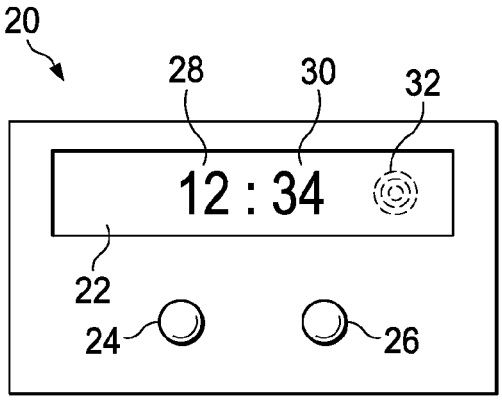
FIG. 2 is a front view of the apparatus of the present invention.

Referring now to FIG. 2, illustrates the portable incontinence prompting apparatus of the present invention. The incontinence function control unit 20, which is a chronograph/alarm capable of keeping time having a visual display panel 22, a time interval set 24 for setting the proper time interval and an alarm selection signal button 26. The incontinence function control unit 20 is powered by one or more batteries (not shown).

A visual display panel 22 is operatively connected to a conventional internal time keeping apparatus (not shown). Many such timepieces are known by those skilled in the art of watchmaking including, but not limited to, a mechanical or electrical watch or clock capable of keeping accurate time. Such a timepiece may readily be designed or adapted to fit snuggly within the body of the incontinence function control unit 20.

The visual display panel 22 may be any suitable visual display such as a light emitting diode (LED) or a liquid crystal display (LCD). In one embodiment, an LCD is used since this type of display is more energy efficient and more easily read in the daylight.

Included within the visual display panel 22 are an hour indicator 28 and a minute indicator 30. Likewise, the hour indicator 28 and the minute indicator 30 numerically display the appropriate hour and minutes respectively. In some embodiments, the alarm mode indicator 32 is also included in the visual display panel 22. Addition information may be included in the visual display panel 22 as well, e.g., the time, the date, the day, etc. In another embodiment, the visual display panel 22 is a LED that is illuminated above the corresponding time interval.

The incontinence function control unit 20 is provided with an alarm, which is operatively connected so that the alarm is triggered by the internal time keeping apparatus (not shown). The alarm is activated for a brief period, such as 30 seconds. Alternatively, the alarm is activated for 45 seconds, 60 seconds, 90 seconds, 120 seconds or until the alarm is turned off or reset. The alarm may have a manual switch to terminate the alarm prior to the automatic shut off or the alarm may be deactivated before completion of the signal.

In one embodiment, the incontinence function control unit 20 has one, two, three, and/or four different alarm modes; a vibratory mode; an auditory mode; a visual mode and a combination mode. In operation, when the alarm is triggered in the vibratory mode, the incontinence function control unit 20 emits, e.g., a steady vibration thereby producing a sensation, which alerts the patient of the need to void the bladder. The intensity of the vibration may be adjustable to a comfortable level or even to a limit sufficient to wake a sleeping patient when used for nocturnal enuresis. This mode is especially effective for patients suffering from diurnal (daytime) urinary incontinence since it alerts only the patient, eliminating undue embarrassment. Triggering the alarm in the auditory mode causes the incontinence function control unit 20 to emit a alerting noise, such as ringing, beeping, chirping, buzzing, song, melody and the like, which is capable of notifying the patient, awakening the patient or alerting a clinician. Triggering the alarm in the visual mode causes the incontinence function control unit 20 to emit a visible signal, such as LED or strobe light to visually alert the patient. In one embodiment, the incontinence function control unit 20 is provided with means to adjust the volume of the alarm according to the needs of the patient, clinician and operating environment. When activated in the combined mode, the alarm causes the incontinence function control unit 20 to simultaneously produce two or more of the above-described effects. This mode is particularly suited for use with patients who require multiple sensory inputs. Another embodiment includes an incontinence function control unit 20 having a vibratory mode, an auditory mode, a visual mode or mixtures and combinations thereof. Yet another embodiment includes an incontinence function control unit 20 having one or more modes including a vibratory mode, an auditory mode or a visual mode.

Alarm mode indicator 32 features different icons corresponding to the appropriate alarm mode. For example, indicator 32 will display a bell to symbolize the auditory mode, a light bulb to symbolize the visual mode, a vibrator to symbolize the vibratory mode or both the bell and vibrator to illustrate the combined vibratory/auditory mode and so on.

In one embodiment, the incontinence function control unit 20 is provided with several pushbutton controls to select and set the various unit functions. The time interval set button 24 is used to set the time interval and the alarm selection signal button 26 is used to select one of the alarm modes.

By way of illustration, in setting the time interval. The time interval set 24 is depressed to enter the set mode indicated by a blinking indicator. The blinking indicator signifies the ability to advance the icon to the next increment by pressing time advance button 24. Pressing time advance button 24 twice, for example, causes hour indicator 28 to blink, the hour can then be advanced by subsequent pressing of time advance button 24. Similarly, alarm signal selection button 26 can be sequentially pressed to choose the desired alarm mode.

Alternatively, the time advance button 24 may be a slider (not shown) that may be positioned to indicia that correspond to the desired time interval. Similarly, the alarm selection signal button 26 may be a slider (not shown), which may be positioned to indicia (not shown) that correspond to the desired type of alarm. Additionally, a slider (not shown) may be used to turn the incontinence function control unit 20 on and off. In another embodiment, a touch screen (not shown) is used to set the time interval, the alarm type and turn the incontinence function control unit 20 on and off. Alternatively, a combination of methods may be used to set the time interval, the alarm type and turn the incontinence function control unit 20 on and off. The skilled artisan will recognize the infinite possibilities and combination that may be used to set the time interval, the alarm type and turn the incontinence function control unit 20 on and off.

Enclosed within the incontinence function control unit 20 is a memory computer chip, not shown, similar to those found in common handheld calculators. Such chips have constant memory and are capable of recording and storing a number of inputs. These chips are operatively connected to the internal time keeping apparatus. The chip in the current invention is preferably capable of storing time intervals.

Figure 3:
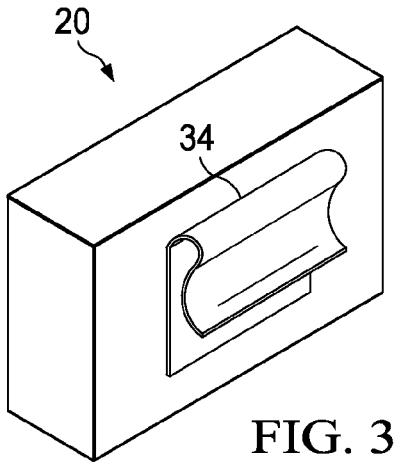
FIG. 3 is an end view of the apparatus of FIG. 1 detailing a clip for attachment.

As shown, the incontinence function control unit 20 may be used with any supportive clothing worn by the patient including a pants, shirt, jacket, belt, or secured to the wristband via attachment clip 34, shown in FIG. 3. Alternatively, the incontinence function control unit 20 may be incorporated into a wearable device like a watch, band, belt buckle or similar item.

Figure 4:
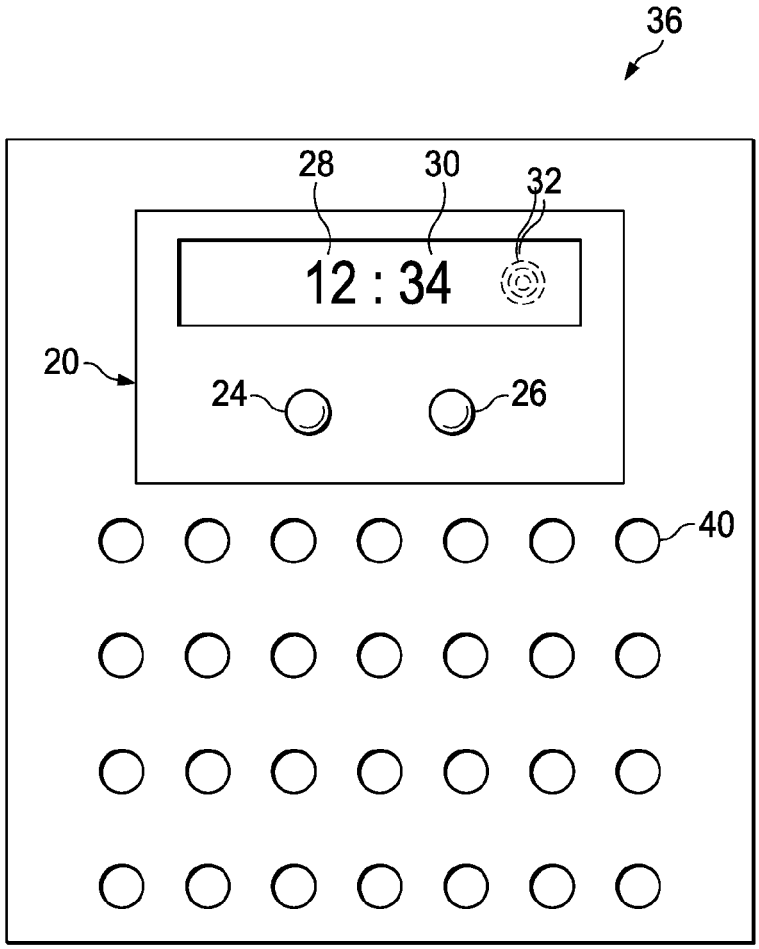
FIG. 4 is a front view of the kit provided by the present invention.

FIG. 4 illustrates a kit provided by the present invention. The kit 36 includes the incontinence function control unit 20 packaged with the pharmacologically active agents 40 packaged into the kit 36 used in conjunction with the incontinence timer 20 to aid the user in managing incontinence. The kit 36 may be shrink wrapped, blister wrapped or otherwise packaged to include the incontinence timer 20 and the doses of pharmacologically active agents 40. The pharmacologically active agents 40 include pharmaceutical formulations known to the skilled artisan, e.g., parasympatholytics (e.g., oxybutynin, propiverine or tolterodine), tricyclic antidepressants (e.g., imipramine), muscle relaxants (e.g., flavoxate), ephedrine, clenbutarol, hormones, tramadol, opioids (e.g., diarylmethylpiperazines and piperidines) pharmaceutically acceptable salt thereof, combinations and mixtures thereof. The include the incontinence timer 20 includes a visual display panel 22, a time interval set 24 for setting the proper time interval and an alarm selection signal button 26.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An incontinence prompting apparatus comprising:

a timer mechanism for timing an interval disposed within a housing;

a time interval selection mechanism in communication with the timer mechanism for selecting a preset time interval comprising 30 minutes, 60 minutes, 90 minutes, 120 minutes, 150 minutes, 180 minutes or combinations thereof;

a time interval adjustment mechanism in connection with the time interval selection mechanism, wherein the user can modify the preset time interval to customize the preset time interval;

a storage device that stores the preset time interval;

a prompting mechanism in communication with the timer mechanism for issuing a prompting signal in response to a signal from the timer timing mechanism, wherein the prompting mechanism comprises a vibrating mechanism connected to the prompting mechanism to make a nonauditory prompting signal; an auditory mechanism, a visual mechanism or a combination thereof;

a speaker connected to the prompting mechanism to make an auditory prompting signal;

a visual indicator connected to the prompting mechanism to make a visual prompting signal;

a prompting selector connected to the prompting mechanism to select one or more prompting signals;

a reset mechanism to reinitiate the timer mechanism;

an input mechanism in operable communication with the prompting selector, the prompting signal, the storage device, the time interval selection mechanism, the timer mechanism;

a messaging mechanism to provide one or more messages to the user, wherein the one or more messages comprises the time remaining, the time lapsed, the time interval selected, alarm mode, the date, the time, the day, the month or combinations thereof;

a logging mechanism in communication with the storage device to record one or more logged data selected from the time of the incontinent episodes, subjective amount of the incontinent episodes, and cause of an accidental urination; and a communication device to connect and transmit the one or more logged data to a remote host;

a touch screen display mechanism in communication with the time interval selection mechanism, prompting selector, the storage device, the messaging mechanism, the prompting mechanism, the timer mechanism, the logging mechanism and input mechanism to display the one or more logged data, the one or more messages or both.

2. A portable incontinence kit for prompting of urination events comprising:

a incontinence timer comprising a timer mechanism disposed within a housing for timing intervals, a time interval selection mechanism in communication with the timer mechanism for selecting a preset time interval, a time interval adjustment mechanism in connection with the time interval selection mechanism, wherein the user can modify the preset time interval to customize the preset time interval;

a reset mechanism in communication with the timer mechanism to reinitiate the timer mechanism, a prompting mechanism in communication with the timer mechanism for issuing a prompting signal in response to a signal from the timer mechanism, wherein the prompting mechanism comprises a vibrator mechanism connected to the prompting mechanism to make a nonauditory prompting signal, a speaker connected to the prompting mechanism to make an auditory prompting signal, a visual indicator connected to the prompting mechanism to make a visual prompting signal, and a prompting selector connected to the prompting mechanism to select one or more prompting signals, a storage device in communication with the timer mechanism, the time interval selection mechanism, the reset mechanism, and the prompting mechanism, a display mechanism for displaying data, a messaging mechanism to provide one or more messages, wherein the messaging mechanism is in communication with the display mechanism the time interval selection mechanism, the prompting mechanism, the timer mechanism, and input mechanism, a display screen in communication with the display mechanism for displaying one or more messages in communication with the time interval selection mechanism, the prompting mechanism, the timer mechanism, and input mechanism, a logging mechanism in operable communication with the input mechanism, the display screen and the display mechanism, wherein the logging mechanism is in communication with the storage device to record one or more logged data selected from a time of the incontinent episodes, a subjective amount of the incontinent episodes, and a cause of the incontinent episodes, and a preprogrammed time interval routine in communication with the time interval selection mechanism, the prompting mechanism, the timer mechanism, the logging mechanism and input mechanism to prompt the display mechanism to display one or more messages relating to one or more pharmacologically active agents in communication with the time interval selection mechanism; and one or more pharmacologically active agents, wherein the one or more pharmacologically active agents comprise parasympatholytics, tricyclic antidepressants, muscle relaxants, ephedrine, clenbutarol, hormones, tramadol, opioids, combinations and mixtures thereof.

3. The kit of claim 2, wherein the storage device is a book, a PDA, a computer, a note pad or combination thereof.

4. A method of controlling incontinence through voiding comprising the steps of:

providing an incontinence timer comprising a timer mechanism disposed within a housing for timing an interval, a time interval selection mechanism disposed in or about a housing for selecting a preset time interval and in communication with the timer mechanism, a prompting mechanism in communication with the timer mechanism for issuing a prompting signal in response to a signal from the timer mechanism, a reset mechanism to reinitiate the timer mechanism, an input mechanism for recording a volume of a scheduled controlled urination, a display mechanism for displaying one or more messages in communication with the time interval selection mechanism, prompting mechanism, the timer mechanism, and input mechanism wherein the preset time interval comprises 30 minutes, 60 minutes, 90 minutes, 120 minutes, 150 minutes 180 minutes or combinations thereof; a time interval adjustment mechanism in connection with the time interval selection mechanism, wherein the user can modify the preset time interval to customize the preset time interval; a logging mechanism in operable communication with the input mechanism and the display mechanism, wherein the logging mechanism comprises a storage device to record one or more logged data selected from a time of an incontinent episode, a subjective amount of the incontinent episode, and a cause of the incontinent episode;

displaying the prompting signal to prompt an input of the time interval;

selecting the time interval;

adjusting the time interval using the time interval adjustment mechanism;

starting the time interval;

timing the time interval until the time interval expires;

producing the prompting signal to prompt voiding;

prompting the input of a time and date of the incontinent episode that is unscheduled;

storing the time of the incontinent episode;

prompting the input of a subjective amount of the voiding;

storing the subjective amount of the voiding of the incontinent episode;

prompting the input of a cause of the voiding;

storing the cause of the voiding of the incontinent episode; and displaying the prompting signal to prompt an input of the time interval wherein incontinence is treated through the use of the incontinence timer to prompt voiding and the time interval for voiding, subjective amount of voiding and the cause of the voiding is recorded to optimize the time interval for a specific individual.

5. The method of claim 4, wherein the time interval selection mechanism comprises a slider, a knob, a button, a touch screen or a combination thereof.

6. The method of claim 4, wherein the prompting signal is in communication with a vibrating mechanism, an auditory mechanism, a visual mechanism or a combination thereof.

7. The method of claim 4, wherein the prompting mechanism comprising a buzzer, a speaker, a vibration mechanism, a light, an LED or combination thereof.

8. The method of claim 4, wherein the incontinence timer further comprising a display mechanism for displaying one or more messages.

9. A prompting apparatus for prompting of urination events comprising:

a timer mechanism disposed within a housing for timing one or more intervals;

a time interval selection mechanism disposed in or about the housing and in communication with the timer mechanism for selecting a preset time interval comprising 30 minutes, 60 minutes, 90 minutes, 120 minutes, 150 minutes and 180 minutes, wherein the time interval selection mechanism comprises a knob, a slider, a button, a touch screen or a combination thereof;

a time interval adjustment mechanism in connection with the time interval selection mechanism, wherein the user can modify the preset time interval to customize the preset time interval;

a reset mechanism to reinitiate the timer mechanism; and a prompting mechanism in communication with the timer mechanism for issuing a signal in response to the timer timing mechanism, wherein the prompting mechanism comprises a buzzer, a speaker, a vibration mechanism, a light, an LED or combination thereof.

10. A single package incontinence kit for prompting the treatment of incontinence urination events comprising:

a incontinence timer comprising a timer mechanism for timing an interval disposed within a housing;

a time interval selection mechanism in communication with the timer mechanism for selecting a preset time interval comprising 30 minutes, 60 minutes, 90 minutes, 120 minutes, 150 minutes, 180 minutes or combinations thereof;

a storage device that stores the preset time interval;

a prompting mechanism in communication with the timer mechanism for issuing a prompting signal in response to a signal from the timer timing mechanism, wherein the prompting mechanism comprises a vibrating mechanism connected to the prompting mechanism to make a nonauditory prompting signal; an auditory mechanism, a visual mechanism or a combination thereof;

a speaker connected to the prompting mechanism to make an auditory prompting signal;

a visual indicator connected to the prompting mechanism to make a visual prompting signal;

a prompting selector connected to the prompting mechanism to select one or more prompting signals;

a reset mechanism to reinitiate the timer mechanism;

an input mechanism in operable communication with the prompting selector, the prompting signal, the storage device, the time interval selection mechanism, the timer mechanism;

a messaging mechanism to provide one or more messages to the user, wherein the one or more messages comprises the time remaining, the time lapsed, the time interval selected, alarm mode, the date, the time, the day, the month or combinations thereof;

a logging mechanism in communication with the storage device to record one or more logged data selected from the time of the incontinent episodes, subjective amount of the incontinent episodes, and cause of an accidental urination; and a communication device to connect and transmit the one or more logged data to a remote host;

a touch screen display mechanism in communication with the time interval selection mechanism, prompting selector, the storage device, the messaging mechanism, the prompting mechanism, the timer mechanism, the logging mechanism and input mechanism to display the one or more logged data, the one or more messages or both; and one or more pharmacologically active agents packaged in a single package with the incontinence timer, wherein the one or more pharmacologically active agents comprise parasympatholytics, tricyclic antidepressants, muscle relaxants, ephedrine, clenbutarol, hormones, tramadol, opioids, combinations and mixtures thereof.

11. A wearable incontinence apparatus for the treatment of incontinence comprising:

a timer mechanism for timing an interval disposed within a housing;

a time interval selection mechanism in communication with the timer mechanism for selecting a preset time interval comprising 30 minutes, 60 minutes, 90 minutes, 120 minutes, 150 minutes, 180 minutes or combinations thereof;

a time interval adjustment mechanism in connection with the time interval selection mechanism, wherein the user can modify the preset time interval to customize the preset time interval;

a storage device that stores the preset time interval;

a prompting mechanism in communication with the timer mechanism for issuing a prompting signal in response to a signal from the timer timing mechanism, wherein the prompting mechanism comprises a vibrating mechanism connected to the prompting mechanism to make a nonauditory prompting signal; an auditory mechanism, a visual mechanism or a combination thereof;

a speaker connected to the prompting mechanism to make an auditory prompting signal;

a visual indicator connected to the prompting mechanism to make a visual prompting signal;

a prompting selector connected to the prompting mechanism to select one or more prompting signals;

a reset mechanism to reinitiate the timer mechanism;

an input mechanism in operable communication with the prompting selector, the prompting signal, the storage device, the time interval selection mechanism, the timer mechanism;

a messaging mechanism to provide one or more messages to the user, wherein the one or more messages comprises the time remaining, the time lapsed, the time interval selected, alarm mode, the date, the time, the day, the month or combinations thereof;

a logging mechanism in communication with the storage device to record one or more logged data selected from the time of the incontinent episodes, subjective amount of the incontinent episodes, and cause of an accidental urination; and a communication device to connect and transmit the one or more logged data to a remote host;

a touch screen display mechanism in communication with the time interval selection mechanism, prompting selector, the storage device, the messaging mechanism, the prompting mechanism, the timer mechanism, the logging mechanism and input mechanism to display the one or more logged data, the one or more messages or both, wherein the housing comprises a watch, or a phone.

* * * * *